United States Patent [19]

Sato et al.

[11] Patent Number: 4,589,828

[45] Date of Patent: May 20, 1986

[54] ROTATION PREVENTING DEVICE FOR AN ORBITING MEMBER OF A FLUID DISPLACEMENT APPARATUS

[75] Inventors: Tadashi Sato; Seiichi Sakamoto; Kiyoshi Terauchi, all of Gunma, Japan

[73] Assignee: Sanden Corporation, Japan

[21] Appl. No.: 521,257

[22] Filed: Aug. 8, 1983

[30] Foreign Application Priority Data

Aug. 7, 1982 [JP] Japan ..... 57-137649

[51] Int. Cl.[4] ..... F01C 1/02

[52] U.S. Cl. ..... 418/55; 464/103

[58] Field of Search ..... 418/55; 464/103, 102

[56] References Cited

U.S. PATENT DOCUMENTS

| | | | |
|---|---|---|---|
| 801,182 | 10/1905 | Creux . | |
| 847,069 | 3/1907 | Hawkins . | |
| 916,914 | 3/1909 | Cooley | 464/103 |
| 1,041,721 | 10/1912 | Ball | 418/55 |
| 1,884,976 | 10/1932 | Johnson | 464/103 |
| 1,906,142 | 4/1933 | Ekelhof . | |
| 1,907,447 | 7/1933 | Schlitz . | |
| 2,333,611 | 11/1943 | Wolf | 464/103 |
| 2,343,244 | 3/1944 | Rose | 464/103 |
| 3,454,283 | 7/1969 | Benjamin et al. | 464/103 |
| 3,500,119 | 3/1970 | Price . | |
| 4,160,629 | 7/1979 | Hidden et al. . | |
| 4,259,043 | 3/1981 | Hidden et al. . | |
| 4,303,379 | 12/1981 | Hiraga et al. . | |
| 4,406,600 | 9/1983 | Terauchi et al. | 418/55 |
| 4,424,010 | 1/1984 | McCullough | 418/55 |
| 4,468,181 | 8/1984 | Sakamoto | 464/103 |

FOREIGN PATENT DOCUMENTS

| | | | |
|---|---|---|---|
| 17886 | 6/1934 | Australia . | |
| 1960216 | 6/1971 | Fed. Rep. of Germany . | |
| 928465 | 12/1947 | France . | |
| 976187 | 10/1950 | France . | |
| 881409 | 11/1981 | U.S.S.R. | 464/103 |

*Primary Examiner*—Douglas Hart

*Attorney, Agent, or Firm*—Banner, Birch, McKie & Beckett

[57] ABSTRACT

A rotation preventing/thrust bearing device for use in an orbiting piston type fluid displacement apparatus is disclosed. The rotation preventing/thrust bearing device includes a fixed portion, an orbital portion and bearing elements. The bearing elements are cylinder shaped and placed between facing pairs of pockets formed in the fixed and orbital portion. The bearing elements are axially slidable in the pockets. The outer peripheral surface of the bearing elements contacts the opposing inner walls of the pockets, whereby rotation of the orbiting piston is prevented and the axial thrust load from the orbiting piston is carried through cylindrical shaped elements.

7 Claims, 6 Drawing Figures

ROTATION PREVENTING DEVICE FOR AN ORBITING MEMBER OF A FLUID DISPLACEMENT APPARATUS

BACKGROUND OF THE INVENTION

This invention relates to a fluid displacement apparatus, and more particularly, to an improvement in a rotation preventing device for an orbiting member of a fluid displacement apparatus.

There are several types of fluid displacement apparatus which utilize an orbiting member, such as a piston or a scroll driven by a shaft coupled to an end surface of the orbiting member. One such apparatus, disclosed in U.S. Pat. No. 1,906,142 issued to John Ekelof, is a rotary machine provided with an annular, eccentrically movable piston adapted to act within an annular cylinder provided with a radial transverse wall. One end of the cylinder wall is fixedly mounted and the other cylinder wall consists of a cover or disc connected to the annular piston, which is driven by a crank shaft. Other prior art apparatus, which consist of a scroll type fluid displacement apparatus, are shown in U.S. Pat. Nos. 801,182 and 3,500,119. Though the present invention applies to either type of fluid displacement apparatus, i.e., using either an annular piston or a scroll type piston, for purposes of illustration and not limitation the description of the invention will be set in the context of a scroll type compressor.

The above mentioned U.S. Pat. No. 801,183 (Creux) discloses a device including two scrolls each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets increases or decreases dependent on the direction of the orbital motion. The scroll type fluid displacement is thus applicable to compress, expand or pump fluids.

Generally, in the conventional scroll type fluid displacement apparatus, one scroll is fixed to a housing of the apparatus and the other scroll, which is the orbiting scroll, is eccentrically supported on a crank pin of a rotating shaft to cause orbital motion. The scroll type apparatus also includes a rotation preventing device which prevents rotation of the orbiting scroll to thereby maintain the scroll in a predetermined angular relationship during operation of the apparatus.

Because the orbiting scroll in conventional scroll type apparatus is supported on the crank pin in a cantilever manner, the orbiting scroll may be subject to an axial slant or tilt. An axial slant occurs also because the movement of the orbiting scroll is not rotary motion, but rather orbiting motion caused by the eccentric movement of a crank pin driven by the rotation of the drive shaft. Several problems result from the occurrence of this axial slant, including improper sealing of line contacts, vibration of the apparatus during operation, and noise caused by physical striking of the spiral elements. One simple and direct solution to these problems is the use of a thrust bearing device for carrying the axial loads. Thus, conventionally, a scroll type fluid displacement apparatus is usually provided with a thrust bearing device within the housing.

One recent attempt to improve the rotation preventing and thrust bearing devices in scroll type fluid displacement apparatus is described in U.S. Pat. Nos. 4,160,629 and 4,259,043 both of which are issued to Hidden et al. The rotation preventing and thrust bearing functions in these U.S. patents are integral with one another. The rotation preventing/thrust bearing device according to these patents comprises one set of indentations formed on the end surface of the circular end plate of the orbiting scroll and a second set of indentations formed on the end surface of the fixed plate attached to the housing. A plurality of balls or spheres are placed between the indentations of both surfaces. All the indentations have the same cross-sectional configuration and the centers of all the indentations formed on both end surfaces are located on circles having the same radius.

In this construction of the rotation preventing/thrust bearing device, during the operation of the apparatus, the balls are held within the indentations by the edge of opposing pairs of indentations. Thus, the rotation of the orbiting scroll is prevented by the balls, while the angular relationship between both scrolls is maintained. Furthermore, during operation each ball is in contact with both end surfaces and rolls along both indentations, so that the axial load from the orbiting scroll, caused by the reaction force of the compressed gas, is carried by one surface through the balls. Since the contact between ball and end surface is formed as a point contact, the pressure acting against the end surface is increased and separation of the end surfaces is likely to occur.

SUMMARY OF THE INVENTION

It is a primary object of this invention to provide an improved rotation preventing/thrust bearing device for an orbiting member of a fluid displacement apparatus.

It is another object of this invention to provide a rotation preventing/thrust bearing device for an orbiting member of a fluid displacement apparatus with improved resistance to wear.

It is a further object of this invention to provide a rotation preventing/thrust bearing device which is simple to make and produce.

A fluid displacement apparatus according to this invention includes a housing. A fixed member is attached to the housing and has a first end plate from which a fixed fluid displacement member extends into the interior of the housing. An orbiting member has a second end plate from which an orbiting fluid displacement member extends. The fixed and orbiting fluid displacement members interfit at a radial offset to make a plurality of line contacts which separate a fluid inlet from a fluid outlet. A driving mechanism, including a drive shaft rotatably supported by the housing, is connected to the orbiting member to effect the orbital motion of the orbiting member. A rotation preventing/thrust bearing device is connected to the orbiting member for preventing the rotation of the orbiting member during orbital motion so that the line contacts between the fixed and orbiting members move toward the discharge side during the orbital motion.

The rotation preventing/thrust bearing device comprises a first ring member fixed on the housing and having a plurality of holes or pockets. A second ring member is fixed on the orbiting member and also has a plurality of corresponding, axially aligned, opposing, holes or pockets. A cylindrical-shaped bearing element is placed in each pair of opposing pockets.

Further objects, features and other aspects of this invention will be understood from the following detailed description of a preferred embodiment of this invention, referring to the annexed drawings.

DETAILED DESCRIPTION OF THE PREFERRED EMBODIMENT

Figure 1:
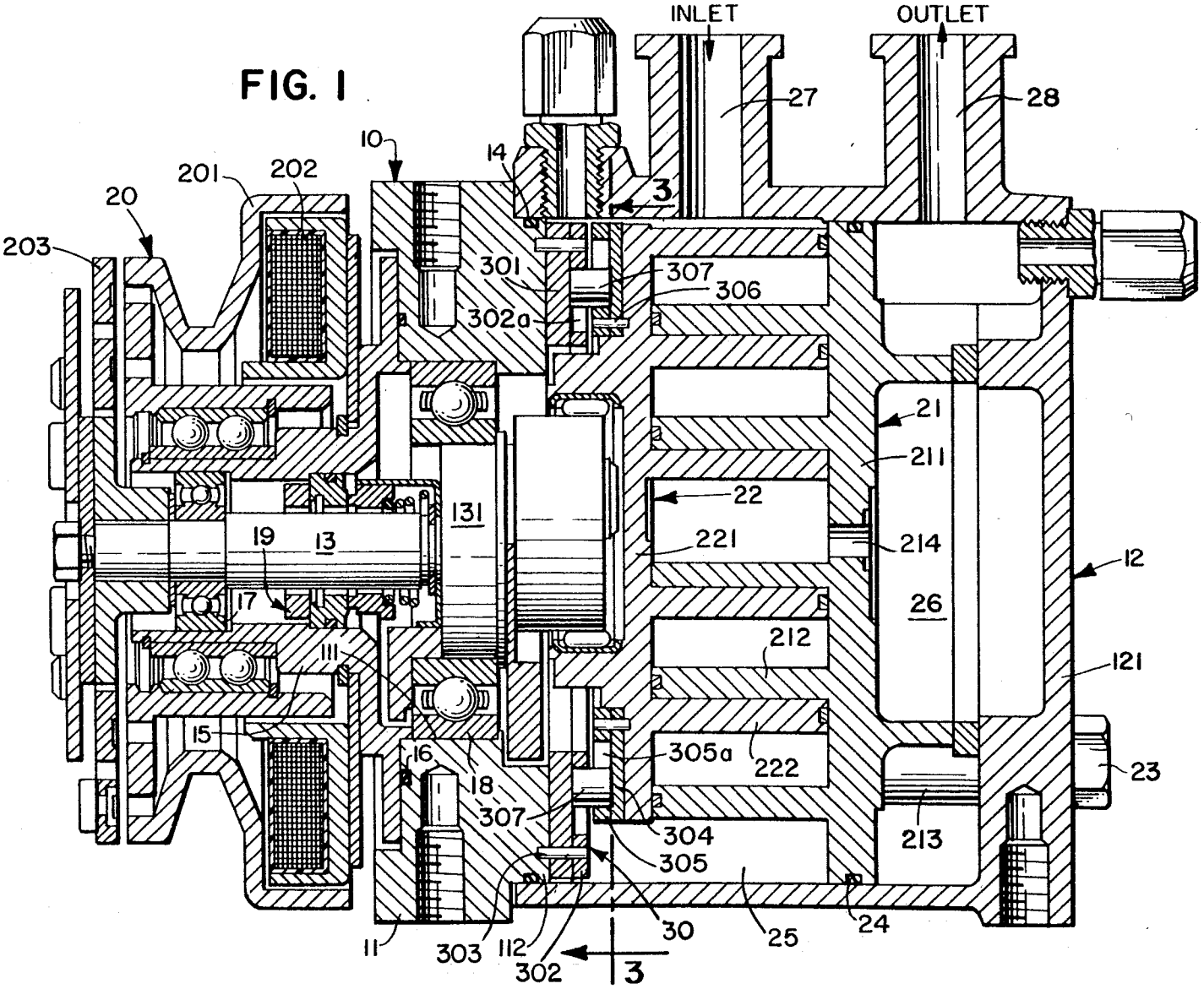
FIG. 1 is a vertical sectional view of a compressor unit according to one embodiment of this invention.

Referring to FIG. 1, a fluid displacement apparatus in accordance with the present invention is shown in the form of a scroll type refrigerant compressor unit. The compressor unit includes compressor housing 10 having a front end plate 11 and a cup shaped casing 12 which is attached to an end surface of front end plate 11. An opening 111 is formed in the center of front end plate 11 for the penetration or passage of drive shaft 13. An annular projection 112, concentric with opening 111, is formed on the rear or inside surface of front end plate 11, and projects towards cup shaped casing 12. An outer peripheral surface of annular projection 112 contacts an inner wall surface of cup shaped casing 12. Cup shaped casing 12 is fixed on the inside surface of front end plate 11 by a fastening device, for example, bolts and nuts (not shown), so that the opening of cup shaped casing 12 is covered by front end plate 11.

Drive shaft 13 is rotatably supported by sleeve 15 through a bearing 17. Drive shaft 13 has a disk shaped portion 131 at its inner end which is rotatably supported by front end plate 11 through a bearing 18 located within opening 111 of front end plate 11. A shaft seal assembly 19 is assembled on drive shaft 13 within the shaft seal cavity of sleeve 15.

An electromagnetic clutch 20, which comprises a pulley 201, electromagnetic coil 202, and an armature plate 203, is disposed on the outer portion of sleeve 15 to control the transmission of external power to the compressor.

A fixed scroll 21, an orbiting scroll 22, a driving mechanism for orbiting scroll 22 and a rotation preventing/thrust bearing device for orbiting scroll 22 are located within an inner chamber of cup shaped casing 12. The inner chamber is formed between the inner wall of cup shaped casing 12 and front end plate 11.

Fixed scroll 21 includes a circular end plate 211, a wrap or spiral element 212 affixed to or extending from one end surface of circular end plate 211 and a plurality of internally threaded bosses 213 axially projecting from the other end surface of circular end plate 211. An axial end surface of each boss 213 is seated on the inner surface of an end plate 121 of cup shaped casing 12 and fixed by bolts 23. Circular end plate 211 partitions the inner chamber of cup shaped casing 12 into two chambers, such as a discharge chamber 26 and a suction chamber 25. A seal ring 24 is located between the outer peripheral surface of end plate 211 and the inner wall of cup shaped casing 12. A hole or discharge port 214 is formed through circular end plate 211 at a position near the center of spiral element 212. Discharge port 214 connects the central fluid pocket formed in the center of the interfitting of the spiral elements and discharge chamber 26.

Orbiting scroll 22 also includes a circular end plate 221 and a wrap or spiral element 222 affixed to or extending from one side surface of circular end plate 221. Spiral element 222 and spiral element 212 interfit at an angular offset and a predetermined radial offset. At least a pair of sealed off fluid pockets are thereby defined between both spiral elements 212, 222. Orbiting scroll 22, which is connected to the driving mechanism and to the rotation preventing/thrust bearing device, is driven in an orbital motion at a circular radius by rotation of drive shaft 13 to thereby compress fluid passing through the compressor unit, according to the general principles described above. Generally, the radius of orbital motion is given by the following formula:

$$R_o = (\text{pitch of spiral element}) - 2(\text{wall thickness of spiral element})/2$$

The pitch of spiral element can be defined by 2 rg, where rg is the involute generating circle radius. The radius of orbital motion $R_o$ is also illustrated as the locus of an arbitrary point on orbiting scroll 22. The spiral element 22 is radially offset from spiral element 212 of fixed scroll 21 by the distance $R_o$. Thus, orbiting scroll 22 undergoes orbital motion of a radius $R_o$ upon rotation of drive shaft 13.

As the orbiting scroll 22 orbits, the line contacts between spiral elements 212, 222 move toward the center along the spiral curved surfaces of spiral elements 212, 222. The fluid pockets defined by spiral elements 212, 222 also moved towards the center with a consequent reduction of their volume and thus a compression of the fluid in the fluid pockets. Fluid or refrigerant gas, introduced into suction chamber 25 from an external fluid circuit through inlet port 27 formed on cup shaped casing 12, is drawn into the fluid pockets formed between spiral elements 212, 222. Following the orbital motion of orbiting scroll 22, the fluid in the fluid pockets is compressed and subsequently discharged into discharge chamber 25 from the central fluid pocket of the spiral elements through hole 214. The fluid is then discharged to the external fluid circuit through outlet port 28 formed in cup shaped casing 12.

Figure 2:
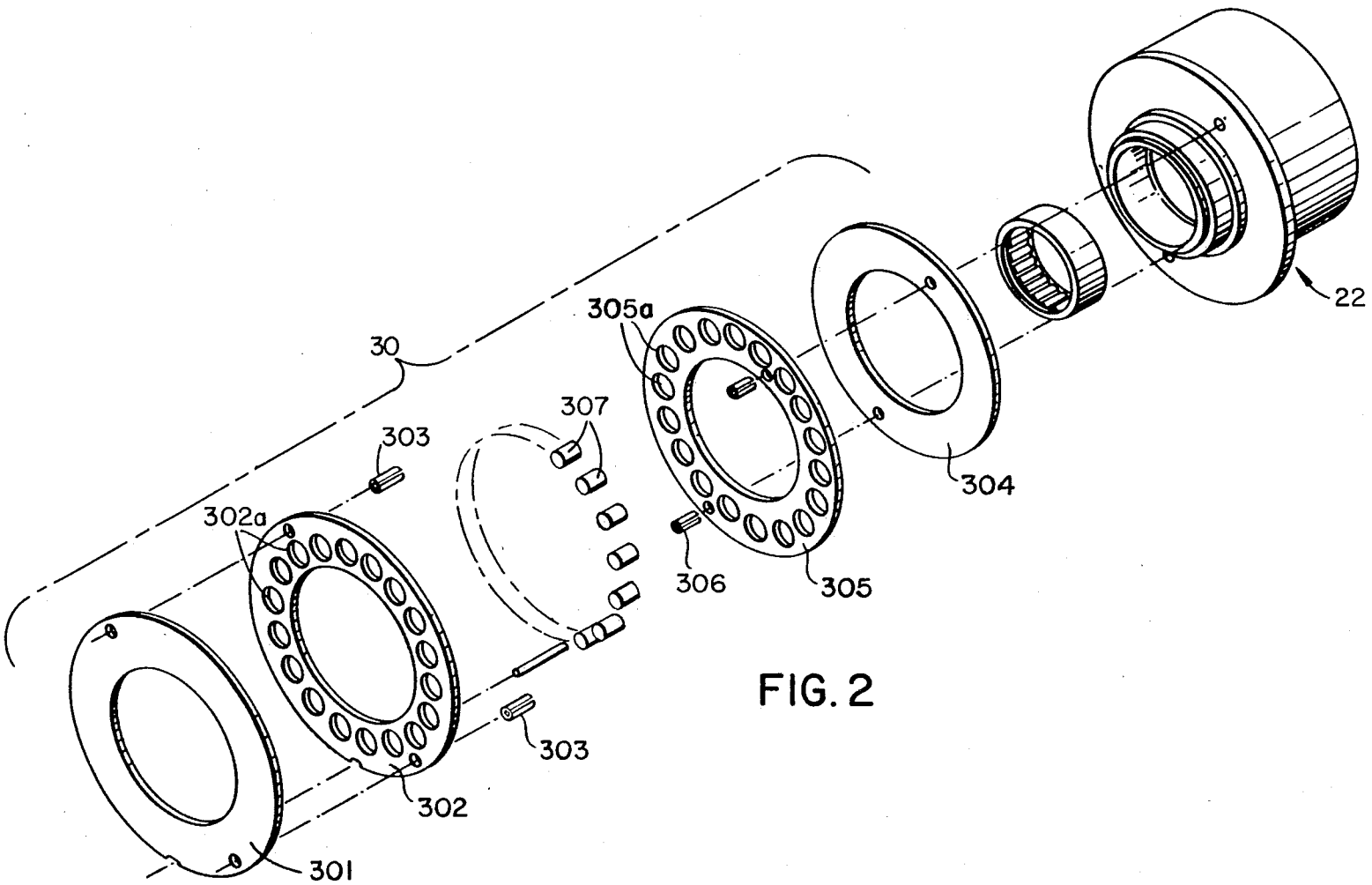
FIG. 2 is an exploded perspective view of a rotation preventing/thrust bearing device used in FIG. 1.
Figure 3:
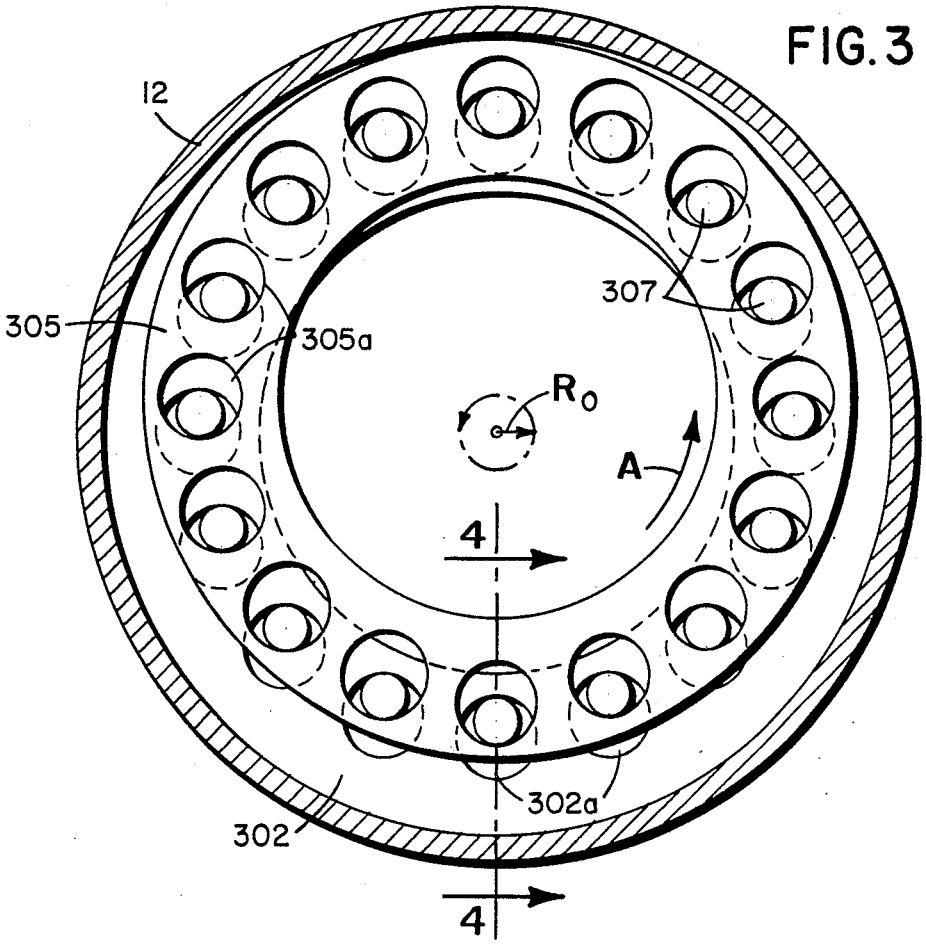
FIG. 3 is a sectional view taken along the line III—III in FIG. 1.
Figure 4:
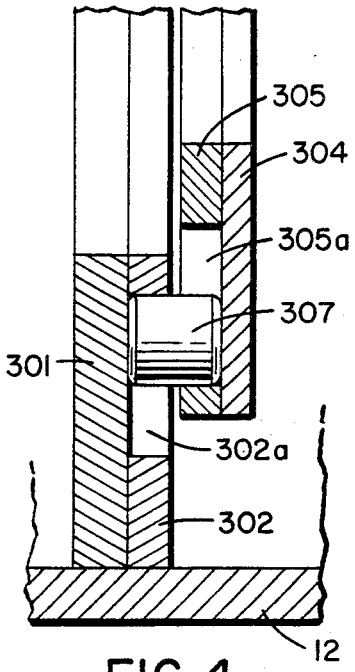
FIG. 4 is a sectional view taken along the line 4—4 in FIG. 3.

Referring to FIGS. 2, 3 and 4, rotation preventing/thrust bearing device 30 will be described. Rotation preventing/thrust bearing device 30 includes a fixed portion, an orbiting portion, and bearings.

The fixed portion includes a fixed annular race 301 and a fixed ring 302 formed separately from fixed race 301. Annular fixed race 301 is placed within an annular groove formed on the axial end surface of annular projection 112 of front end plate. Fixed ring 302 is fitted against an axial end surface of fixed race 301. Race 301 and ring 302 are fixed on the end surface of annular projection 112 by pins 303.

The orbiting portion includes an annular orbital race 304 and an orbital ring 305 formed separately from orbital race 304. Orbital race 304 is placed within an annular groove formed on the end surface of circular plate 221 of orbiting scroll 22. Orbital ring 305 is fitted against an axial end surface of orbital race 304. Race 304 and ring 305 are fixed on the end surface of circular plate 221 by pins 306.

Fixed ring 302 and orbital ring 305 face each other with a predetermined clearance and each have a plurality of axially aligned, corresponding holes or pockets 302*a* and 305*a*, respectively. The radius of each of the pockets 302*a* of fixed ring 302 is the same as the radius of each of the pockets 305*a* of orbital ring 305. Pockets 302*a* of fixed ring 302 correspond in location to pockets 305*a* of orbital ring 305. The center of each pair of pockets 302*a*, 305*a* are radially offset by an amount equal to the distance $R_o$. Bearings, such as cylindrical shaped elements 307, are placed between the facing pairs of pockets 302*a*, 305*a*.

Referring to FIG. 3, the operation of the rotation preventing/thrust bearing device will be described. In FIG. 3, the center of orbital ring 305 is shown at its upper position and the direction of rotation of the drive shaft is counterclockwise, as indicated by arrow A. When orbiting scroll 22 is driven by the rotation of the drive shaft, the center of orbital ring 305 orbits about a circle of radius $R_o$ (together with orbiting scroll 22). However, a moment is caused by the offset of the acting point of the reaction force of the compression and the acting point of the drive force acting on orbiting scroll 22. This reaction force tends to rotate orbiting scroll 22 in a counterclockwise direction about the center of orbital ring 305. But, as shown in FIG. 3, the cylindrical shaped elements 307 are placed between the corresponding pockets 302*a*, 305*a* of rings 302 and 305. In the position shown in FIG. 3, the contact of the elements 307 at the right side of the rotation preventing/thrust bearing device with the walls of fixed pockets 302*a* prevents the rotation of orbiting scroll 22; the cylindrical shaped elements 307 on the left side of the device, do not contact the walls of fixed pockets 302*a* and thus, in the position shown in FIG. 3, do not serve to prevent rotation of rings 305 and race 304. In any given position of orbiting scroll 22, it will be appreciated that only half the cylindrical shaped elements 307 function to prevent the rotation of orbiting scroll 22. However, all the cylindrical shaped elements 307 support the axial thrust load from orbiting scroll 22. The axial end surfaces of cylindrical shaped elements 307 face, and slidably contact, fixed and orbiting races 301, 304. This axial thrust load is transmitted to fixed race 301 through cylindrical shaped elements 307.

In this construction of rotation preventing/thrust bearing device 30, fixed race 301 and orbital race 304 are preferably formed of aluminum alloy, a soft metal, and both rings 302, 305 and cylindrical shaped elements 307 are preferably formed of a hard metal, such as steel. Therefore, the wear resistance and fit of the interface of the sliding surfaces of cylindrical shaped elements 307 and races 301, 304 is improved because of the hard metal to soft metal sliding contact. Alternatively, races 301 and 304 can be made of hard metal and cylindrical shaped elements 307 can be made of soft metal. Furthermore, the rotation preventing force is received by a hard metal in the preferred embodiment. The breakage of the pockets, which may occur if the rings 302, 305 and cylindrical shaped elements are formed of the soft metal, will also be prevented. Furthermore, if the wear surfaces of elements 307 and rings 302, 305 are treated to further improve their wear resistance, the compressor may be operated without additional lubrication.

Figure 5:
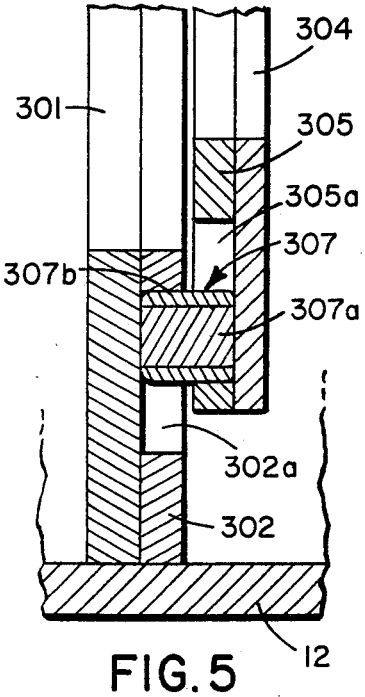
FIGS. 5 and 6 are a vertical sectional view of a part of a rotation preventing/thrust bearing device according to other embodiments of this invention.

As shown in FIG. 5, cylindrical shaped element 307 may be formed of a soft metal body 307*a*, such as an aluminum alloy, with its longitudinal, cylindrical wear surface covered by a cylindrical bushing of hard metal, as shown at 307*b*.

Figure 6:
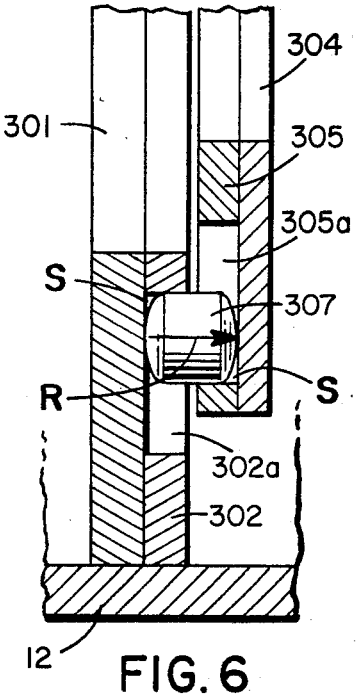

An alternative construction for elements 307 is shown in FIG. 6. The axial end surfaces of cylindrical shaped element 307 are formed with a small curvature, of radius R. In this construction, a wedge shaped space S is defined between the end surface of race 301, 304 and the axial end surface of cylindrical shaped element 307. During the operation of the compressor, oil which is contained in the compressor penetrates into space S and develops a thrust oil pressure. This oil pressure supports the thrust load from orbiting scroll 22 without contact between the race and the cylindrical shaped element.

This invention has been described in detail in connection with preferred embodiments. However, this description is for purposes of illustration only. It will be understood by those skilled in the art that other variations and modifications can be easily made within the scope of this invention which is limited only by the following claims.

What is claimed is:

1. In an orbiting member fluid displacement apparatus including a housing, a fixed member attached to said housing and having a first end plate from which a fixed fluid displacement member extends into the interior of the housing, an orbiting member having a second end plate from which an orbiting fluid displacement member extends, said fixed and orbiting fluid displacement members interfitting at a radial offset to make a line contact separating a fluid inlet from fluid outlet, and a driving mechanism connected to said orbiting member to drive said orbiting member in an orbital motion at a predetermined orbital radius, and rotation preventing/thrust bearing means connected to said orbiting member for preventing rotation of said orbiting member and for carrying axial thrust load from said orbiting member during orbital motion, the improvement wherein said rotation preventing/thrust bearing means comprises:

an orbital body fixed to said orbiting fluid displacement member;

a fixed body fixed to said housing, said fixed body facing said orbital body at a predetermined clearance;

said fixed and orbital bodies each having a plurality of axially aligned, radially offset opposing pockets; and a cylindrical shaped bearing element carried within each pair of said opposing pockets, with one of the axial end surfaces of said bearing elements in sliding contact with an orbital race of said orbital body, the other axial end surface of said bearing elements in sliding contact with a fixed race of said fixed body, and the outer cylindrical bearing surface of at least some of said bearing elements engaging the walls of said pockets in said fixed body so that the engagement of said bearing elements with the walls of said pockets prevents rotation of said orbiting member and the axial end surfaces of said bearing elements carry the axial thrust load from said orbiting member to said fixed member.

2. In a scroll type fluid displacement apparatus including a housing, a fixed scroll fixedly disposed relative to said housing and having a first end plate from which a first wrap extends into the interior of said housing, an orbiting scroll having a second end plate from which a second wrap entends, said first and second wraps interfitting at an angular and radial offset to make a plurality of line contacts to define at least one pair of sealed off fluid pockets, a driving mechanism operatively connected to said orbiting scroll to effect the orbital motion, and rotation preventing/thrust bearing means connected to said orbiting scroll for preventing the rotation of said orbiting scroll during orbital motion, the improvement wherein said rotation preventing/-thrust bearing means comprises:

an orbital annular race fixed on said second end plate of said orbiting scroll and an orbital annular ring fitted to an axial end surface of said orbital annular race;

a fixed annular race fixed on said housing and a fixed annular ring fitted to an axial end surface of said fixed annular race;

said fixed annular ring facing said orbital annular ring at a predetermined clearance and said orbital annular ring and said fixed annular ring each having a plurality of axially aligned, radially offset opposing pockets; and a cylindrical shaped bearing element carried within each pair of said opposing pockets with one of the axial end surfaces of said bearing elements in sliding contact with said orbital annular race, the other axial end surfaces of said bearing elements in sliding contact with said fixed annular race, and the outer cylindrical bearing surface of at least some of said bearing elements engaging the walls of said pockets in said fixed body so that the outer cylindrical bearing surface of said bearing elements prevents rotation of said orbiting scroll and the axial end surfaces of said bearing elements carries the axial thrust load from said orbiting scroll to said fixed member.

3. The scroll type fluid displacement apparatus of claim 2 wherein said orbital annular race is formed of soft metal, said fixed annular race is formed of soft metal and said bearing elements are formed of a hard metal.

4. The scroll type fluid displacement apparatus of claim 2 wherein said orbital and said fixed annular races are formed of a hard metal and said bearing elements are formed of a soft metal.

5. The scroll type fluid displacement apparatus of claim 2 wherein said bearing elements comprise a soft metal core portion and a hard metal cylindrical bushing surrounds the longitudinal, cylindrical wear surface of said core portion.

6. The scroll type fluid displacement apparatus of claim 2 wherein an axial end surface of said bearing elements is curved so that a space is formed between the axial end surface of said bearing elements and said fixed and orbital races, thus permitting oil to penetrate said spaces and develop a thrust oil pressure.

7. The scroll type fluid displacement apparatus of claim 2 wherein the axial end surfaces of said bearing elements are in sliding contact with said fixed and orbital annular races.

* * * * *